US006382200B1

(12) United States Patent
Levkov

(10) Patent No.: US 6,382,200 B1
(45) Date of Patent: May 7, 2002

(54) TRIGGER MECHANISM

(76) Inventor: Sergey Levkov, 24932 Ave. Kearney Unit 1, Valencia, CA (US) 91355

( * ) Notice: Subject to any disclaimer, the term of this patent is extended or adjusted under 35 U.S.C. 154(b) by 0 days.

(21) Appl. No.: 09/531,391

(22) Filed: Mar. 21, 2000

Related U.S. Application Data

(60) Provisional application No. 60/125,392, filed on Mar. 22, 1999.

(51) Int. Cl.[7] ..... F41B 11/00

(52) U.S. Cl. ..... 124/73; 42/69.02; 42/69.01; 124/71

(58) Field of Search ..... 42/69.01, 69.02, 42/69.07, 7; 89/195, 196; 124/71, 73

(56) References Cited

U.S. PATENT DOCUMENTS 3,857,322 A * 12/1974 Lichtman ..... 89/145
4,505,182 A * 3/1985 Sullivan ..... 89/132
5,857,280 A * 1/1999 Jewell ..... 42/69.03

* cited by examiner

*Primary Examiner*—Peter M. Poon
*Assistant Examiner*—Bethany L. Griles
(74) *Attorney, Agent, or Firm*—Roger A. Marrs

(57) ABSTRACT

A trigger mechanism having a trigger plate slidably carried in a firearm frame for linear movement. The plate includes a rear cam surface on which a sear functions via a cam follower. The plate is provided with a single hole for holding a leg or pin of a firing valve L-shaped member. The frame has a pair of aligned slots separated by the trigger plate for slidably receiving the leg or pin of the L-shaped member. A stop lug is integrally provided on the trigger plate ahead of the L-shaped member mounting hole operable to engage the frame to stop forward movement by the trigger plate. An anti-frictional coating or finish is carried on external surfaces of the trigger plate and the sear.

14 Claims, 2 Drawing Sheets

FIG. 3
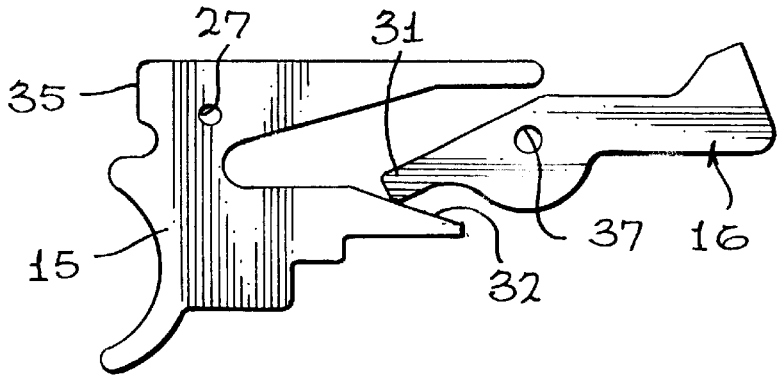
FIG. 4
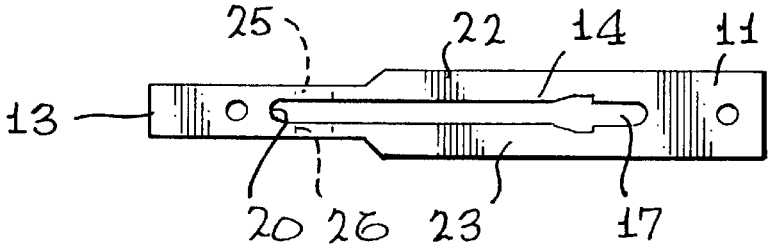
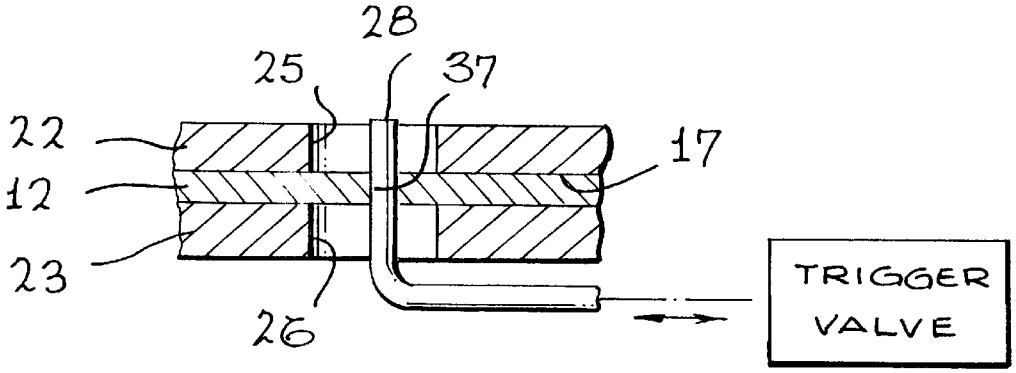
FIG. 5

TRIGGER MECHANISM

Priority claimed based on Ser. No. 60-125,392 filed Mar. 22, 1999

BACKGROUND OF THE INVENTION

1. Field of the Invention

The present invention relates to the field of weapons, and more particularly to a novel trigger mechanism for a gun or pistol which improves trigger action and user feel.

2. Brief Description of the Prior Art

In the past, it has been the conventional practice to incorporate a trigger mechanism on a gun body, such as a pistol or the like, which includes a trigger for operating a hammer or pin for firing a shell or round. The trigger is generally employed to operate a sear, which is pivotally mounted between the trigger and the hammer so that the action is controlled and positive. The trigger is also employed to operate a valve rectilinearly through the use of an L-shaped member, whose short pin or end is placed through a slot in the trigger. Usually, the trigger is mounted in such a fashion in a slot so that the trigger is permitted to move rectilinearly for a short distance, such as 1/32nd to 1/8th of an inch of movement. For high performance use, it is best to reduce the amount of movement of the trigger so that the linear travel of the trigger is limited. The conventional means for limiting the movement of the trigger in a fore and aft direction resides in placing the short leg of the L-shaped member through a slot in the trigger and the corresponding slot in the frame in which the trigger is mounted. Using the slot in the trigger creates a delay in firing since a long actuating stroke is encountered in moving the plunger of the firing valve. The use of a pin-in-slot arrangement is a negative delay which reduces efficiency and causes delay in valve operation. A stop is effected in both a fore and aft movement when the slot in the trigger engages the L-shaped member against the slot in the trigger frame.

In addition to reducing the movement or throw of the trigger, most triggers are provided with an irregular or roughened surface which detracts from the "feel" of the trigger to the user. The rougher the surfaces of the trigger, the more unnatural or unreal the feel of the trigger becomes.

In view of the foregoing, a long need has existed to provide a trigger mechanism which includes a trigger having a short throw or reduced linear movement within the recess of the frame or body and which has improved surface texture for allowing smoother movement between the trigger of the frame or body during operation. By reducing the movement of the trigger using travel stops or the like and by polishing and smoothing the surface texture of the trigger, an improved trigger feel will be more natural and realistic.

SUMMARY OF THE INVENTION

Accordingly, the above problems and difficulties are avoided by the present invention which provides a trigger mechanism having a trigger or trigger plate which incorporates a single opening through which the shank of an L-shaped lug is disposed that retains the trigger plate on the frame or body. The frame or body includes a recess into which the trigger plate is located and includes an opening for a finger catch to protrude externally of the frame or body. The trigger plate further includes a travel stop that extends forward of the plate so as to engage with the end of the recess to terminate forward travel of the plate during a triggering procedure. The opposite end of the plate includes a cam surface on which one end of a sear is engaged in cam-like fashion. A pivot pin secures the mid-section of the sear to the frame or body of the firearm or piece.

Therefore, it is among the primary objects of the present invention to provide a trigger mechanism including a trigger plate which has a simple circular mounting hole for accommodating mounting of the plate to the frame or body of a firearm and which further includes a travel stop in alignment with the circular hole whereby forward movement of the trigger plate terminates in a shorter distance than is conventionally possible.

Another object of the present invention is to provide a novel trigger mechanism which incorporates a novel single hole mounting for the valve pin and which further includes a lug or ear serving as a travel stop immediately ahead of the trigger plate which shortens the linear movement distance through which the trigger plate is intended to travel.

A further object of the present invention is to provide a novel trigger plate for a trigger mechanism having a surface texture which is polished and smoothed to a high degree which when taken in combination with the short moving distance of the trigger plate, provides a natural and realistic feel of the trigger with respect to the user's finger during the course of firing the firearm.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 3 is a side elevational view of a trigger mechanism used in the pistol body shown in FIGS. 1 and 2;

FIG. 4 is a reduced top plan view of the firearm frame or body; and

FIG. 5 is a fragmentary sectional view of the pin, hole and slots.

DESCRIPTION OF THE PREFERRED EMBODIMENT

Figure 1:
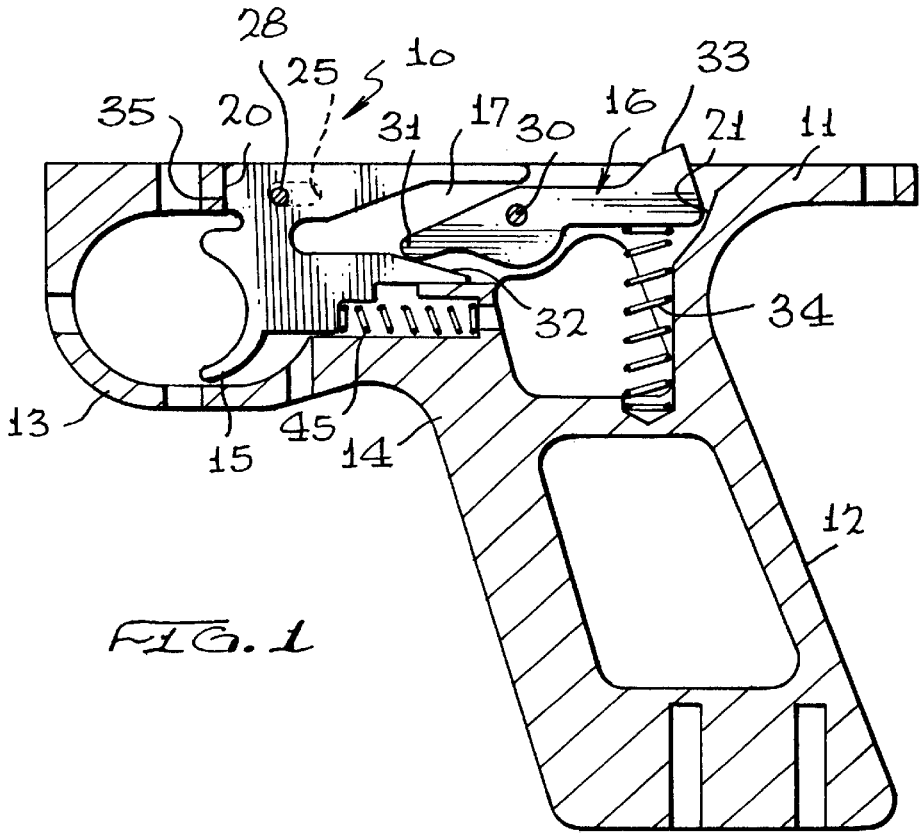
FIG. 1 is a cross-sectional view of a pistol body of a firearm illustrating the trigger mechanism utilizing the present invention.

Referring to FIG. 1, a firearm is illustrated having a frame or body 11 wherein the trigger mechanism is illustrated in the general direction of arrow 10. The frame or body includes a pistol grip portion 12 and a trigger guard 13 joined to the grip 12 by a mid-section 14. The trigger mechanism 10 comprises a trigger 15 and a sear 16. The trigger and sear are movably supported in a channel or recess 17 shown in FIGS. 1 and 4. The channel or recess 17 is elongated and is open at the top of frame 11. The trigger mechanism moves in a rectilinear position back and forth between opposite ends of the recess which include shoulders 20 at the trigger end of the frame 11 and by shoulder 21 at the opposite end of the recess terminating with the grip 12. The opposite sides of the channel or recess 17 defined by opposite walls 22 and 23 in FIG. 4, are further provided with elongated slots 25 associated with wall 22 and slot 26 associated with wall 23. An "L-shaped" lug passes through the slots 25 and 26 and includes a shank which passes through a circular opening 27 in the trigger 15. It is particularly noted that the opening 27 is circular and is of a different configuration than the elongated slots 25 and 26. Therefore, as the trigger 15 is moved back and forth within the recess 17, the lug will move between the opposite ends of the slots 25 and 26; however, there is no delay or lost motion in the movement of trigger plate 15. In conventional triggers, the lug passes through an identical elongated slot in the trigger plate so that lost motion is encountered which provides an unrealistic and sloppy feel to the user of the firearm. The shank of the L-shaped lug is identified by numeral 28 and it is to be understood that a circular hole is employed to accommodate the diameter and cross-section of the lug 28.

Immediately behind the trigger plate 15 is the sear 16 which is carried on the frame 11 by means of a pivot 30 and the sear includes an end 31 serving as a cam follower resting on a cam surface 32. Therefore, as the trigger plate 15 moves back and forth in response to the finger pressure of the user, the sear will pivot on pivot 30 in response to the cam and cam follower engagement since the cam represents an inclined ramp. The opposite end of the sear includes a projection 33 intended to release or strike the firing hammer of the firearm (note shown). A coil spring 45 is employed to return the trigger to its position shown in FIG. 1. Spring 34 expands against the end 33 of the sear causing it to pivot in a counterclockwise direction forcing the sear to move counterclockwise. The forward movement of the trigger 15 is arrested by means of a lug or "lump" identified by numeral 35, which outwardly projects from the end of the trigger 15 to engage with the shoulder 20. Normally, no such projection or lug is employed so that the conventional trigger may incur a delay and take longer and drive further before stopping.

Figure 2:
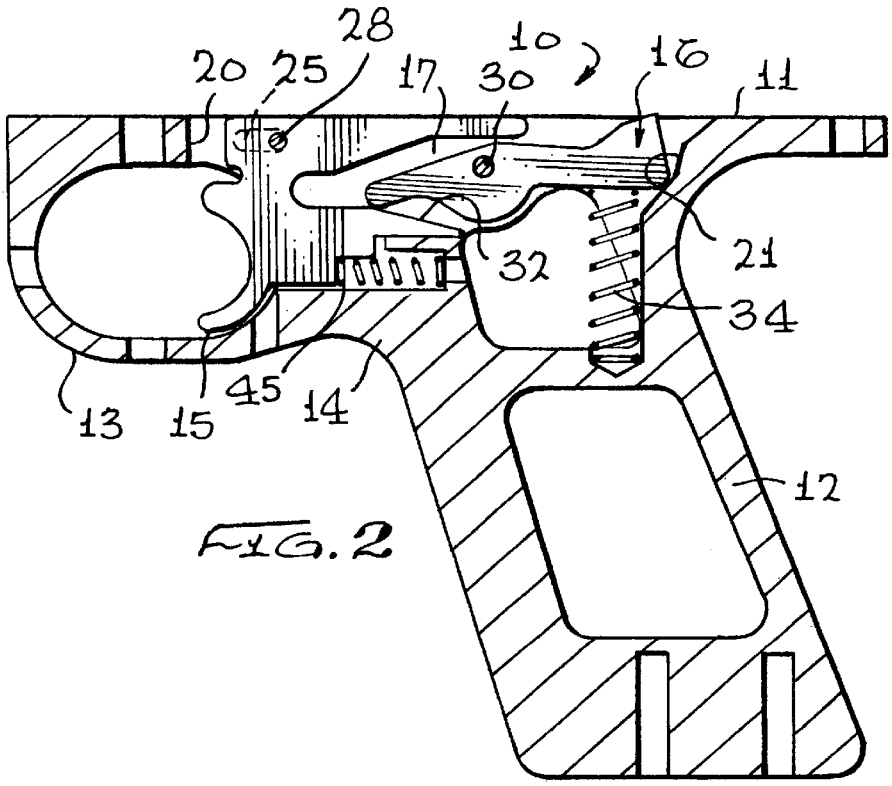
FIG. 2 is a view similar to the view of FIG. 1 illustrating the trigger mechanism in its firing position.

Referring now in detail to FIG. 2, the trigger 15 has been pulled rearwardly by the user's finger when inserted into the finger guard 13 so that the sear 16 is pivoted against the resilient spring 34. The spring depresses as the sear is pivoted clockwise due to the engagement of the cam follower 31 and the cam 32. The L-shaped pin 28 rides through the elongated slots 25 and 26. It is to be understood that the shank of the pin occupies the circular opening 27 so that there is no wasted space or room between the pin and the circular hole through it passes in the trigger 15. FIG. 2 further illustrates that when the trigger 15 has been moved to its rearmost position, the lug 35 leaves the shoulder 20 and it can also be seen that the distance between these components is considerably shortened when compared to a trigger that is devoid of the lug 35.

Referring now to FIG. 3, the trigger 15 and sear 16 are illustrated as flat plates and that trigger 15 includes the circular hole 27 while numeral 37 illustrates a hole for receiving pivot 30. It is again emphasized that the forward end of the trigger 15 includes a forward projection or lug 35 which shortens the distance between the front edge of the trigger 15 and the shoulder 20 on the frame 11. Therefore, it can be seen that the lug constitutes a travel stop for the trigger mechanism when progressing in the forward direction. It is also to be noted that the surface texture on both the trigger 15 and the sear 16 in the trigger mechanism 10 is of a highly polished surface so that anti-friction features are experienced against the opposing sides of the recess 17 between the walls 22 and 23. Conventional trigger mechanisms do not include such anti-friction means and because of this, the feel and operation of the trigger mechanism is sluggish and, in some instances, relatively nonresponsive.

Therefore, it can be seen that by providing a forwardly projecting lug on the front upper edge of the trigger 15, a shorter distance of travel is required, enabling the trigger to stop when the lug bears against shoulder 20. Also, by providing a circular opening 30 in the trigger 15 rather than an elongated slot, a more positive feel and connection between the trigger and the L-shaped pin is achieved. By highly polishing and plating the external surfaces of both the trigger and sear, an improved sliding relationship between the trigger mechanism and the sidewalls 22 and 23 is achieved.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A trigger mechanism comprising:

a firearm frame having a trigger recess defined between frame sections;

a trigger plate slidably disposed in said trigger recess and having a valve actuating hole; and a trigger valve operating member having a pin extending through said hole and movable in a limited rectilinear direction in response to sliding movement of said trigger plate.

2. The trigger mechanism defined in claim 1 wherein:

said firearm frame includes a pair of aligned slots in said frame sections separated by said trigger plate and in alignment with said hole for slidably accommodating said pin.

3. The trigger mechanism defined in claim 2 including:

a sear pivotally disposed on said frame in said recess and operably engaged by said trigger plate in response to rectilinear movement to said trigger plate.

4. The trigger mechanism defined in claim 3 including:

an anti-frictional coating carried on said trigger plate and said sear to provide smooth and unrestricted movement between said frame sections.

5. The trigger mechanism defined in claim 4 wherein:

said pin and said hole are joined in an interference type fit to establish securement whereby said trigger valve operating member and plate move in unison.

6. The trigger mechanism defined in claim 5 including:

a compression spring disposed between said sear and said frame normally urging said sear in a counter-clockwise direction.

7. The trigger mechanism defined in claim 6 including:

a lug integrally carried on said trigger plate serving as a stop engageable with said frame.

8. In a trigger mechanism for operating a firing mechanism operatively mounted on a frame, the combination comprising:

a flat trigger plate movably carried on said frame for moving in a fore and aft direction with respect to said frame;

said frame having a recess defined between a pair of frame sidewalls and said recess occupied by said trigger plate;

said frame having a forward shoulder terminating one end of said recess serving as a stop for terminating movement of said trigger plate in said fore direction;

said trigger having a circular hole of a given diameter;

said frame sections having an elongated slot in axial alignment with said hole in said plate; and a trigger pin occupying said hole and passing through said slots.

9. The trigger mechanism defined in claim 8 including:

a lobe or lug integrally provided on said trigger plate adapted to engage said front shoulder to terminate movement of said trigger plate in a forward direction of said fore and aft direction.

10. The trigger mechanism defined in claim 9 including:

a rear stop for said trigger plate to terminate rearward movement thereof with a selected frame end of said frame slots constituting said rear stop.

11. A trigger mechanism comprising:

a gun frame having a recess defined between separated wall sections;

said wall sections provided with aligned elongated slots separated by said recess;

said frame having a front stop shoulder at one end of said recess and said slots having a rear end constituting a rear stop shoulder;

a trigger plate slidably carried in said recess between said wall sections and having an actuator hole therein adjacent said slots;

a valve member having a pin totally occupying said hole with opposite ends slidably movable through said slots;

a lug integrally carried on said trigger plate ahead of said hole and said pin for engaging with said front stop shoulder to terminate movement of said trigger mechanism in a forward direction; and engagement of said pin with said rear stop shoulder terminates movement of said trigger plate in a rearward direction.

12. The trigger mechanism as defined in claim 11 wherein:

said pin having a given thickness which totally occupies said hole to provide an interference fit.

13. The trigger mechanism as defined in claim 12 wherein:

said pin travels approximately three-quarters of the length of said slots and abatement of said lug with said front stop shoulder prevents engagement of said pin with a front end of said slots.

14. The trigger mechanism as defined in claim 13 including:

anti-frictional layer disposed on external surfaces of said trigger plate to reduce friction against said frame as said trigger plate moves between said wall sections.

* * * * *